United States Patent [19]

Weihe et al.

[11] 4,437,781

[45] Mar. 20, 1984

[54] RING BINDER

[75] Inventors: Rolf Weihe; Georg Weihe, both of Kreuztal-Ferndorf, Fed. Rep. of Germany

[73] Assignee: Siplast Siegerländer GmbH, Kreuztal-Ferndorf, Fed. Rep. of Germany

[21] Appl. No.: 375,561

[22] Filed: May 6, 1982

Related U.S. Application Data

[63] Continuation of Ser. No. 853,101, Nov. 21, 1977, abandoned, which is a continuation of Ser. No. 777,316, Mar. 14, 1977, abandoned, which is a continuation of Ser. No. 596,831, Jul. 17, 1975, abandoned, which is a continuation of Ser. No. 433,867, Jan. 16, 1974, abandoned.

[30] Foreign Application Priority Data

Jan. 18, 1973 [DE] Fed. Rep. of Germany ..... 2302365

[51] Int. Cl.[3] ..... B42F 13/00; B42F 13/06

[52] U.S. Cl. ..... 402/8; 402/13; 402/15

[58] Field of Search ..... 402/8, 9, 13, 14, 15, 402/18, 19, 20, 21, 75, 80 R; 24/16 PB; 24/30.5 P; 281/22, 23

[56] References Cited

U.S. PATENT DOCUMENTS

| | | | |
|---|---|---|---|
| 739,332 | 9/1903 | Melzer | 402/19 X |
| 1,829,613 | 10/1931 | Sato | 24/16 PB X |
| 2,042,366 | 5/1936 | Swank | 402/13 |
| 2,124,282 | 7/1938 | Behnke | 402/14 |
| 2,133,069 | 10/1938 | Williamson | 402/15 |
| 2,468,355 | 4/1949 | Ambler | 402/15 |
| 2,559,556 | 7/1951 | Ambler | 402/15 |
| 2,607,351 | 8/1952 | Allison | 402/13 |
| 2,632,657 | 3/1953 | Schade | 402/75 X |
| 2,773,504 | 12/1956 | McGervey | 402/8 |
| 2,936,980 | 5/1960 | Rapata | 24/16 PB |
| 3,238,948 | 3/1966 | Fiedler | 402/19 X |
| 3,315,682 | 4/1967 | Bachman | 402/21 |

FOREIGN PATENT DOCUMENTS

| | | | |
|---|---|---|---|
| 1078537 | 3/1960 | Fed. Rep. of Germany | 402/14 |
| 614196 | 12/1948 | United Kingdom | 402/14 |
| 927840 | 6/1963 | United Kingdom | 402/14 |

*Primary Examiner*—E. R. Kazenske
*Assistant Examiner*—John S. Brown
*Attorney, Agent, or Firm*—Blodgett & Blodgett

[57] ABSTRACT

A ring binder comprising a pair of covers connected by a flexible back portion consisting of a flexible back strip which separates the inner edges of the cover and strip portions which overlap portions of the covers near the inner edges. The overlapping portions of the covers are provided with pairs of holes for receiving flexible binder prong means having a free end which extends through an eye at another end to form a loop.

5 Claims, 9 Drawing Figures

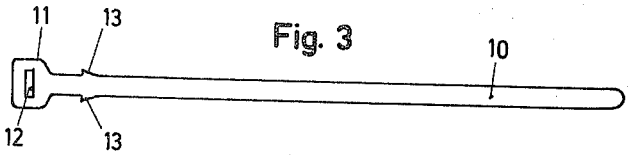
Fig. 3
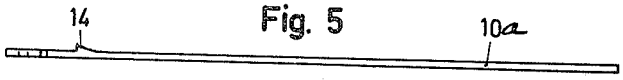
Fig. 5
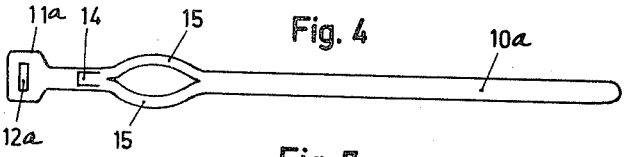
Fig. 4
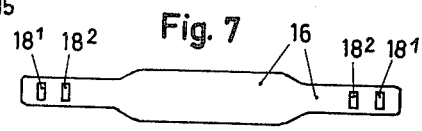
Fig. 7
Fig. 9
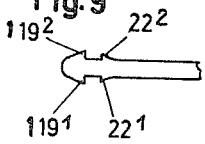
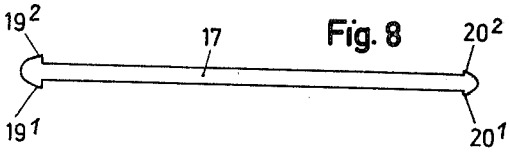
Fig. 8
Fig. 6
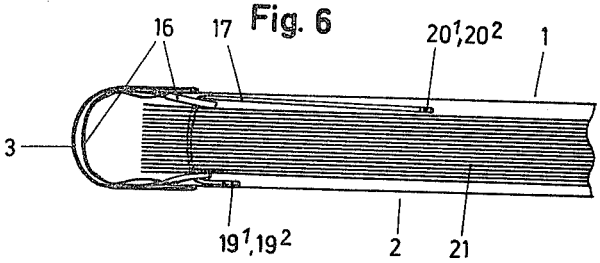

RING BINDER

This is a continuation of application Ser. No. 853,101, filed Nov. 21, 1977, now abandoned which is a continuation of application Ser. No. 777,316, filed Mar. 14, 1977, now abandoned, which is a continuation of Ser. No. 596,831 filed July 17, 1975, now abandoned, which is a continuation of application Ser. No. 433,867, filed Jan. 16, 1974, now abandoned.

BACKGROUND OF THE INVENTION

All of the known binding systems have the main disadvantage that they are not adjustable to correspond to the different requirements. For example, it is not possible with the prior art binders to exchange as required from office bindings into official bindings or visa versa. For this purpose, different types of binders have to be fabricated so as to be able to incorporate the different fastenings and a large assortment must be kept in storage. Also, it is not possible, without difficulty, to change from a two-hole system to a four-hole system or visa versa.

Another disadvantage of the known binding systems is that the threading prongs have to be pulled by hand in order to fasten the material to be inserted, so that they wrap tightly around the fastening edge and so prevent any undesirable penetration of the material to be fastened. Furthermore, it is always necessary, if a bend-free turning of the pages is desired, to enlarge by hand the loop width of the threading system after the binder is opened in such a way that the bound edge of the pages receives a sufficiently large range of movement. The operation of the known binding systems, therefore, is time consuming and troublesome. These and other difficulties experienced with the prior art devices have been obviated in a novel manner by the present invention.

It is, therefore, an outstanding object of the invention to provide a binding system which can be applied to a binder at small cost and can be at any time adjusted to the different fastening-hole arrangements.

Another object of this invention is the provision of an office binder that can be changed to an official binder or visa versa.

A further object of the present invention is the provision of a ring-book-type binder for paper filing, which during opening and closing of the binder, an enforced movement by the binding prongs is achieved. The threading prongs during closure are forcibly reduced in loop size, so that with a filing material pile, formed loops surround narrowly the fastening edge of the material to be fastened and so maintain the material firmly against penetration towards the open edge of the binder; during opening of the binder, the loop width, however, is also forcibly enlarged, so that the fastened pages may be turned over individually but also in groups without a bending of the material at the fastened side resulting.

It is another object of the instant invention to provide a binding system of the type described previously, in which the complex problem is solved simply in such a way that every threading prong is in connection with the two covers of the binder, and with the free parts directed away from the back of the binder engages the connecting parts in longitudinal displacement by forming a loop.

A still further object of the invention is the provision of a binder in which, since the prongs are not fastened to the two covers of the binder, but are guided in a longitudinally displaceable manner, and in which the binding system may be easily adjusted to any desired requirements, i.e., the binders can at any time be changed from office use to official paper filing and changed from a two-hole system to a four-hole system and visa versa.

SUMMARY OF THE INVENTION

In general, the present invention is concerned with a threading system for perforated paper stock, etc., for binders, portfolios, and similar record-filing equipment having two covers connected by a flexible back part, the back being equipped with threading prongs made from plastic or other flexible materials. The threading prongs are threaded through the paper stock and held down by a holder positioned on top of the paper. The threading prongs are guided along the curved surface of the back part in such a way that each of their two ends is positioned loosely on one of the cover parts. One end of each threading prong contains an eye through which the other end can be pulled through in the direction away from the back part of the binder to form a loop. In the simple design, the binding prongs, according to this invention, can be made out of one piece, fitted through holding guides on the two covers of the binders, and guided through the curved surface of the back part of the binder. The ring-binder action of the threading system with the forcible enlargement of the ring loop during opening of the binder, as well as the forcible reduction of the ring loop during closure of the binder is, according to this invention, brought about by a special simple method. The binding prongs with their eyes are guided through the holding guide of one cover and through the holding guides of both covers, with the other end extending out of the holding guide of the holding cover by a considerable length. This procedure assures that a perfect holding down of the pages is guaranteed through the eyes of the prongs.

So that the binding prongs cannot be displaced unintentionally within the holding guides of the binder, it is especially recommended to design the threading prongs in the vicinity of the eyes with locking extrusions which (for fixing the position in the area of the bendable back part) engage the holding guides. It has been proven of advantage to design the holding extrusions in the form of saw-tooth cams.

So that the flexibility at the back part of the binder is not reduced despite the fact that the threading prongs are guided along the curved surface of the back, it is practical, according to a further characteristic of this invention, to split the prongs longitudinally in the part that rests against the back and the two split straps thus formed are bent sidewise away from each other.

It has also been found to be practical to make the binding prongs for simple fabrication from flat material having a rectangular cross-section.

Another characteristic of this invention is that the eyes, together with the neighboring cover, form a holding clamp for the free end of the binding prongs as well as a hold-down for the paper pile.

A binding system with the previously described actions and advantages, according to this invention, may also be formed in such a way that the threading prongs consist of two pieces, wherein one is equipped with eyes on both ends and is held against the curve of the back part of the binder and are guided along this back part in such a way that every one of the eyes is lying loose on one of the covers. The second part, for forming a closed loop, may be pulled through the two eyes of the first part and with its ends able to be turned down in the direction away from the back part. Also, this solution fulfulls completely and advantageously the purpose of this invention with respect to a simple, variable size, and safe-acting binding system which, during opening of the binder, forcibly enlarges and, during closing, forcibly reduces the holding loop.

In this connection, it has been proven to be of advantage that the eyes of the first part be designed in such a way that in its cross-section, the second part with small tolerances has a fitted opening profile and in connection with the neighboring cover, each forms a holding clamp for the pulled-through second part. It is possible to fit the binding system to different page thicknesses and back widths of binders by equipping the first part on each end with several eyes positioned serially.

The second part of the binding prong can be equipped (at least on one end) with hooks as safety devices. This method prevents the holding loops, formed by the threading prongs for paper piles, from loosening themselves unintentionally.

An advantageous technique for the fabrication of the design of the binding prongs results from the way that both parts consist of the same flat material of, for example, rectangular cross-section. The first part of each binding prong in the area between the eyes is equipped with a cross-section enlargement, which preferably is made of a smaller thickness than the end areas having the eyes.

Ring-binder systems with holding loops which enlarge automatically during opening of the binder and automatically reduce and surround closely the fastening edge of the holding material during closing are especially of advantage if they are used in connection with binders on which the holding guides for each binding prong are formed in row-positioned pairs of holes which extend in the bending direction of the back. Each pair of holes in connection with the flexible back part is arranged in each cover for the adaptability of the threading systems to the different requirements such as office filing, official paper filing, two-hole or four-hole system. It is especially of advantage if a number of hole pairs is arranged within both covers lengthwise of the flexible back pat. Such a design which incorporates this binding system may practically be farbicated for a special purpose, if an overlapping is formed between each of the cover sections and the back section and where at the inside of the binder, the pairs of holes are arranged which form the holding guides for the threading prongs. The pairs of apertures may then be punched into the overlapping edge of the cover parts and will be covered on the outside by the overlapping edge of the elastic back parts. The connection between the cover section and the elastic back part can be made hereby along their edges in such a way that two connecting lines in spaced parallel relationship are created, between which the pairs of holes are positioned for forming the holding guides. Finally, a hole of each hole pair can be arranged as a half-round cutout on the edge of the cover section and a welding seam can run along this edge.

BRIEF DESCRIPTION OF THE DRAWINGS

The character of the invention, however, may be best understood by reference to one of its structural forms, as illustrated by the accompanying drawings, in which:

FIG. 3 shows in plan view a prong for forming the binding system, FIGS. 4 and 5 show in view from above and from the side, respectively, a modification of an element of the binding system, FIG. 6 shows a cross-section through a binder design with the modified form of the binding system with a perforated paper pile.

FIG. 7 shows an eye part in plan view,

FIG. 8 also in view shows the threading part of the binding prongs according to the modified form, and FIG. 9 shows a variation of the threading part.

DESCRIPTION OF THE PREFERRED EMBODIMENT

Figure 1:
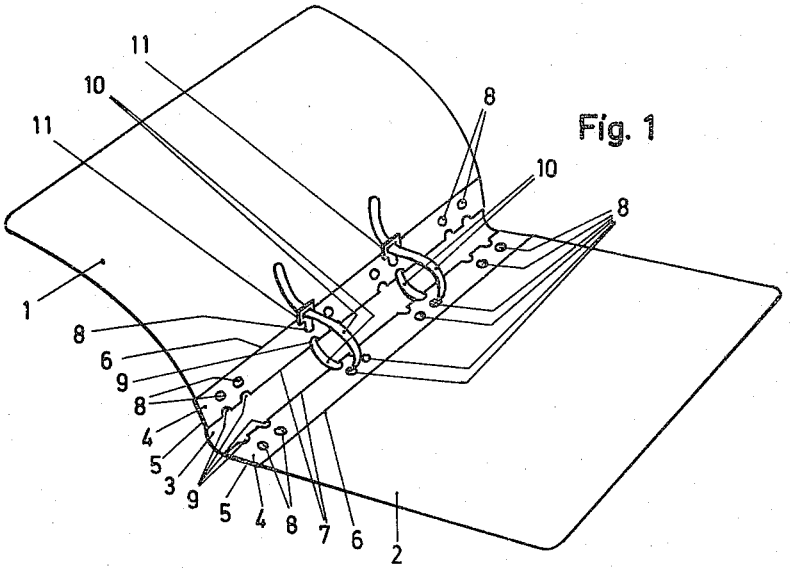
FIG. 1 is a perspective view of a ring binder constructed in accordance with the principles of the present invention.

FIG. 1 shows a paper binder which is formed with two covers 1 and 2 and with a flexible back part 3 connecting the covers. This binder can be made out of cardboard in the common manner, but a better design would be to make this binder out of plastic parts. In such case, the covers 1 and 2 preferably consist of hard plastic but the back part 3 is made from elastic plastic.

The connection of the cover parts 1 and 2 with the back part 3 is done in such a way that edge parts 4 and 5 overlap a certain amount and then are welded along the longitudinal edges 6 and 7 into a single unit. The welded longitudinal edges 6 and 7, therefore, create a doubling of the material which creates a flat hollow space.

Into the edge parts 4 at the inside of the back section 3 on which the cover sections 1 and 2 rest are punched holes 8 and 9 according to a predetermined system. The holes 8 are punched and arranged at a certain distance from the edge 7 and the holes are of circular cross section; the holes 9, however, are half round sections at the edges of the part 4. In the area of the holes 9, the edges 7 of the cover sections 1 and 2 are interrupted by welding seams connecting the back part 3. The two cover sections 1 and 2 are welded to the back part 3 in such a way that two pairs of holes 8, 9 are always positioned transversely of the bending direction of the back part 3 and are positioned in one row. The two positioned pair of holes 8, 9 (always positioned in a row in the bending direction of the back part 3) form a holding guide for a binding prong 10. These holding prongs 10 are simply pushed through the two pairs of holes 8, 9 as can clearly be seen in FIG. 1.

The threading strips 10 have on one end an enlargement 11 which is designed as an eye and for this purpose a slot 12 is formed whose opening profile is fitted with small tolerances to the other parts of the threading prong 10. The threading prongs 10 are pulled through the two pairs of holes 8, 9, so that the enlargement 11 is positioned close to the holes 8, 9 of the cover part 1, and the other end of the prong 10 extends far out of the hole pair 8, 9 of cover 2.

After threading the correspondingly-apertured paper pages onto the prongs 10 extending out of the hole pairs 8, 9, the ends of the prongs can be pushed through the eye opening 12 of the enlarged end part 11 in such a way that a ring loop is formed. In addition, the threading prongs 10 extend through the eye openings 12 in a direction away from the back part.

After the covers 1 and 2 are closed, the enlarged end parts 11 of the threading prongs 10 slide towards the cover 2 on the smaller part of the threading prongs until they rest on the paper pages and press the paper pile together irregardless of whether the pile is large or small. The enlarged end part 11 of each threading prong forms, therefore, not only a holder for the paper sheets, but also act in connection with the cover 1 of the binder as a holding clamp through which the ring loop is clamped tight in closed position. Reversely, the enlarged edge part 11 of the threading prong 10 slides back again during the opening of cover 1, so that the holder of the paper pages lifts and the ring loop enlarges itself. With this method, the paper pages may be turned within the opened binder by 180° without that their edge area being bent.

From FIG. 3 it can be seen clearly that the threading prong 10 with its end enlargement 11 and its eye opening 12 is formed in one piece and consist of flat plastic material with rectangular cross-section.

So that the enlarged end of the threading prong 10 with its eye opening 12 causes the movement of the cover 1 for sure, there are provided in the vicinity of the enlargement 11 saw-tooth type extrusions 13 which may be pulled into the holding guides forming hole pairs 8 and 9, but then are hooked in. According to FIG. 3, such extrusions 13 are arranged on the side edges of the threading prongs 10. In the prong 10*a* shown in FIGS. 4 and 5 these extrusions 14 are arranged on the upper side.

So that the flexibility of the back part 3 is not influenced to disadvantage in spite of the threading prongs 10 pulled through in the bending direction, the threading prongs can be split longitudinally in an area where they rest on the back part 3, so that the two split strips 15 are able to bend away from each other and consequently create a smaller bending resistance.

Figure 2:
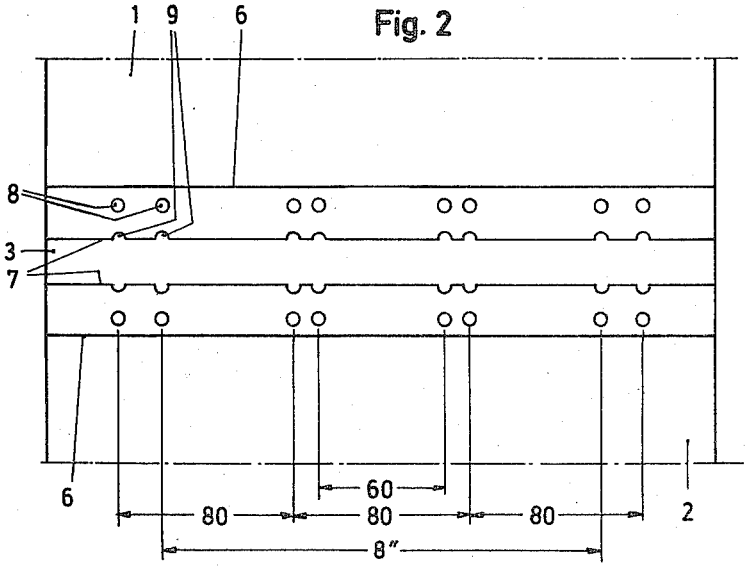
FIG. 2 shows a partial plan view of the binder, where the binding system has not yet been inserted.

FIG. 2 makes it especially clear that it is possible to equip the portfolios or binders with a number of holding guides for threading prongs 10, so that provision is made for threading prongs 10 for filing with various different hole systems. For example, holding guides may be arranged at a distance of 60 mm from each other. In addition, holding guides can be arranged at a distance of 3 times 80 mm. For the filing of small papers, it is additionally possible to arrange holding guides at a distance of 8 inches from each other. Finally, larger binders can be equipped with holding guides for portfolio formats as well as for normal paper with a hole distance of 12 inches.

The binder designed as shown in FIG. 6 has basically the same design as the binder of FIG. 1, that is to say, it consists of the two covers 1 and 2 and with the corresponding back part 3 connecting the parts. Also, the hole pairs 8, 9 serve as holding guides for the threading prongs in the area of the connection between cover 1 and 2 and the flexible back part is present. Only the threading prongs are of different design. They consist of two parts 16 and 17 of which the first part 16 is equipped on both ends with several eyes $18^1$ and $18^2$. The second part 17 corresponds in its cross-section to the opening cross-section of eyes $18^1$ and $18^2$ and is equipped at one or both ends with hook extensions $19^1$, $19^2$, $20^1$, and $20^2$.

The eye piece 16 is always in the desired arrangement, pulled through the pairs of holes 8, 9 forming the holding guides in such a way that on each cover 1 and 2 an end is positioned which is equipped with eyes $18^1$ and $18^2$.

According to the width of the flexible back part 3, the part 17 is pulled through one of the eyes $18^2$ or $18^1$, such the eye end resting on the cover 2. Thereafter, the perforated paper sheets 21 are impailed on the second part 17 of the threading prongs; thereafter, the part 17 of the threading prongs is pulled through one of the eyes $18^1$ or $18^2$ of the eye end positioned on cover 1.

During the closure of the portfolio, the eye end of the eye part 16 slides always on the second part 17 of the threading prongs resting on the movable cover until the binder is completely closed and the two eye ends of eye part 16 rest against the paper pile 21. They form thereby the holder for the paper pile 21 and, in addition, act with the covers 1 and 2 of the binder as holding clamps for the second part 17 of the threading prong.

The manner of operating the binding system according to FIG. 6 (with a design of threading prongs according to FIGS. 7 and 8) is, therefore, similar to the threading system of FIG. 1. The main difference consists of the fact that FIG. 1 uses one-piece threading prongs, whereas FIG. 6 uses threading prongs consisting of two parts 16 and 17. In FIG. 7 it can be seen that the eye part 16 in its positioned area between the eyes $18^1$ and $18^2$ is provided with a cross-section enlargement which has a smaller thickness than the eyes which are located on the end areas. In this way, the elasticity of the eye part will be improved in the portion positioned on the flexible back part 3.

The second part 17 which serves to receive the paper pages 21 can basically have the same cross-section over its total length. To prevent an unintentional loosening of this part from the eyes $18^1$, $18^2$ of the part 16, at least one end of the second part piece 17 is provided with holding cams $19^1$, $19^2$. It also can be of practical value that the outer end also be equipped with holding cams $20^1$ and $20^2$. The holding cams $20^1$ and $20^2$ are smaller in shape than the holding cams $19^1$ and $19^2$ and, therefore, can be loosened somewhat easier from the eye part when, for example, further paper sheets 21 are to be strung onto the prongs.

In FIG. 9 it can be seen that at a distance behind the holding cams $119^1$, $119^2$ are arranged additional, opposed holding cams $22^1$ and $22^2$. By use of this design of the second part 17 of the threading prongs, it will, in any case, be pulled so far through one of the eyes $18^1$ and $18^2$ of eye part piece 16, so that the cams $119^1$, $119^2$ rest on the one side and the holding cams $22^1$ and $22^2$ rest on the other side of the eye and by this method activates a locking in both directions relative to the eye.

Another way of securing the second part consists of providing the inside of the cover with fasteners and arranging that the ends of the second part 17 have in place of the holding cams circular holes, so that an anchoring and securing of the second part is possible on the cover.

On both designs of binding systems for paper sheets, the eyes 12, $18^1$, and $18^2$ can be chamfered on their transverse edges so that they form cutting edges. Along these cutting edges during opening and closing of the binders, the part of the threading prongs which extends through may easily slide. During the closing of the binder, the prong is locked and made safe within the eye.

It can be seen then, that the binding system, according to this invention, for perforated paper piles fulfulls mainly three important functions. First, there is a penetration of the threading prongs through the paper for the purpose of filing in the binder with the loops closely fitting the paper pile. Secondly, it permits an easy and complete bend-free turning of the papers after the opening of the binder, because the threading prongs adjust themselves forcibly to a slack condition. Finally, they act on the parts of the threading prongs in the bending direction of the back part and are guided along the back part not only as a reinforcement of this back part, but they have in addition the advantage that a large part of the forces are taken in by the threading prongs themselves and do not act on the paper binder at all.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A ring binder for perforated paper stock comprising:

(a) a first cover having exterior and interior surfaces and an inner edge, (b) a second cover having exterior and interior surfaces and a inner edge spaced from the inner edge of the first cover, (c) a back part of flexible sheet material connecting the first and second covers and forming a flexible back strip which spans the space between inner edges of the first and second covers for allowing the covers to move between an open coplanar position and a closed, generally spaced, parallel position, said back part overlapping the back surface of the first cover to form a first edge part adjacent the inner edge thereof and overlapping the back surface of the second cover to form a second edge part adjacent the inner edge thereof, said first cover having a first pair of holes at said first part, said second cover having a second pair of holes at said second edge part, said first and second pairs of holes being located along a line which extends transversely across said back part, said back part being attached to the first and second covers along the longitudinal edges of the first and second edge parts, the area extending between the first pair of holes and the area extending between the second pair of holes being unattached, and (d) flexible binding prong means extending through the first pair of holes, along the interior surface of the back part, and also extending through the second pair of holes, the binding prong means having a first free end with an eye for receiving a second free end of the prong means to allow for sliding engagement of the prong means through the eye to form a closed loop.

2. A ring binder as recited in claim 1, wherein the binding prong means has an protrusion adjacent to but spaced from the eye.

3. A ring binder as recited in claim 1, wherein an intermediate portion of the binding prong means is split and separated.

4. A ring binder as recited in claim 1, wherein the binding prong means is a single strip of flat plastic material having an eye at one end and a reduced portion at the opposite end for insertion into the eye.

5. Ring binder for use with rectangular paper stock that is provided with perforations along one edge, comprising:

(a) a first rectangular cover having exterior and interior surfaces, (b) a second rectangular cover having exterior and exterior surfaces, (c) a back part of flexible sheet material joining two edges of the covers in spaced, parallel relationship, the back part being of elongated rectangular shape located so that the parallel long edges are parallel to and spaced from the said edges of the covers, each long edge of the back part being welded to a cover along a line spaced from and parallel to its said edge, while each said edge of each cover is welded to the back part, so that an unattached area exists between each cover and the back part, a first set of four apertures being formed in the covers, the apertures being in alignment transversely of the back part, two of the apertures being formed through each of the two covers to give access to its unattached area, a second set of aperture similar to the first set and located a substantial distance along the back part, (d) a first flexible plastic prong extending through the first set of apertures by passing into and out of the two apertures in the first cover, passing across the interior surface of the back part, and then passing in and out of the two apertures in the second cover, and (e) a second flexible plastic prong extending in the same manner through the second set of apertures, each prong having a first free end with an eye for receiving the second free end to allow for sliding engagement of the prong through the eye to form a closed loop that passes through the perforations in the paper stock, the loop expanding and contracting with opening and closing movement of the covers, respectively.

* * * * *